United States Patent [19]

Thurner et al.

[11] Patent Number: 5,042,953

[45] Date of Patent: Aug. 27, 1991

[54] PAPER GUIDE MEANS FOR PRINTER EQUIPMENT

[75] Inventors: Richard Thurner, Munich; Hans Kusmierz, Gilching, both of Fed. Rep. of Germany

[73] Assignee: Siemens Aktiengesellschaft, Munich, Fed. Rep. of Germany

[21] Appl. No.: 548,923

[22] PCT Filed: Dec. 16, 1988

[86] PCT No.: PCT/DE88/00766

§ 371 Date: Jul. 26, 1990

§ 102(e) Date: Jul. 26, 1990

[87] PCT Pub. No.: WO89/07050

PCT Pub. Date: Aug. 10, 1989

[30] Foreign Application Priority Data

Jan. 28, 1988 [DE] Fed. Rep. of Germany ..... 3802532

[51] Int. Cl.[5] ..... B41J 13/02

[52] U.S. Cl. ..... 400/637.6

[58] Field of Search ..... 400/634, 636, 636.1, 400/636.2, 636.3, 637, 637.1, 637.2, 637.3, 637.4, 637.5, 637.6, 639, 642, 645.2, 645.4, 645.5

[56] References Cited

U.S. PATENT DOCUMENTS

| | | | |
|---|---|---|---|
| 1,627,123 | 5/1927 | Smith | 400/645.5 |
| 1,655,425 | 1/1928 | Kurowski | 400/645.5 |
| 2,218,108 | 10/1940 | Harmon . | |
| 4,215,945 | 8/1980 | Habich et al. | 400/636 |
| 4,364,683 | 12/1982 | Shakib et al. | 400/637 |
| 4,491,854 | 1/1985 | Habelt et al. | 400/637.6 |
| 4,592,670 | 6/1986 | Frank et al. | 400/637.6 |
| 4,773,782 | 9/1988 | Hirano | 400/642 |
| 4,887,922 | 12/1989 | Satave | 400/637.6 |

FOREIGN PATENT DOCUMENTS

| | | | |
|---|---|---|---|
| 0029200 | 5/1981 | European Pat. Off. . | |
| 0082296 | 6/1983 | European Pat. Off. . | |
| 8006325 | 3/1980 | Fed. Rep. of Germany . | |
| 3202216 | 7/1983 | Fed. Rep. of Germany . | |
| 3214549 | 10/1983 | Fed. Rep. of Germany . | |
| 3632863 | 4/1987 | Fed. Rep. of Germany . | |
| 3731538 | 12/1988 | Fed. Rep. of Germany . | |
| 60-32684 | 2/1985 | Japan . | |
| 60-116487 | 6/1985 | Japan . | |
| 2102347 | 2/1983 | United Kingdom | 400/645.5 |
| 2182142A | 10/1986 | United Kingdom . | |

OTHER PUBLICATIONS

"Paper Feed and Index Mechanism", IBM Technical Disclosure Bulletin, vol. 29, No. 7, Dec., 1986, pp. 2865–2866.

*Primary Examiner*—Eugene H. Eickholt

*Attorney, Agent, or Firm*—Hill, Van Santen, Steadman & Simpson

[57] ABSTRACT

The paper guide means is composed of a paper trough fashioned of one piece as a carrier part at which all parts needed for guidance and positioning of the recording medium are combined and in which roller carriers seated moment-free and in pendulum fashion are provided for the acceptance of paper pressing rollers. The pressing power for conveying the paper is exerted by simple, straight bending rods that act on the roller carriers. The spring lift of these bending rods and, thus, the pressing power can be set in a plurality of steps with pivotable adjusting levers. As needed, the adjusting levers can be connected to one another by a coupling rod and can thus be pivoted only in the same direction. The completely pre-assembled paper trough is exactly allocated to the printer equipment as well as to the paper auxiliaries such as feeder, single sheet auxiliary or forms auxiliary via centering noses and is screwed to the printer frame in order to secure the dimensional stability.

9 Claims, 2 Drawing Sheets

FIG 2
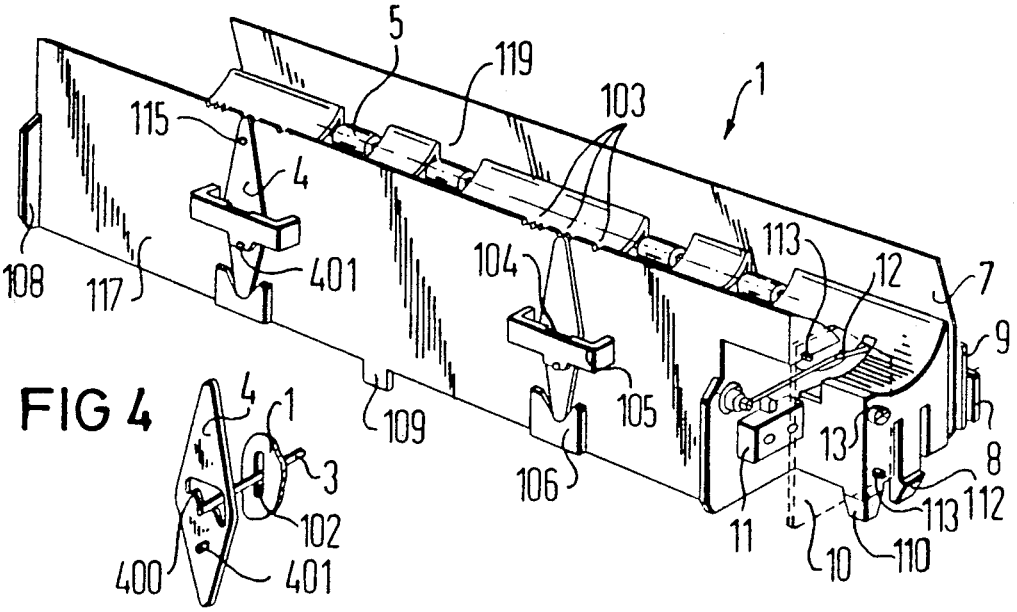
FIG 4
FIG 3
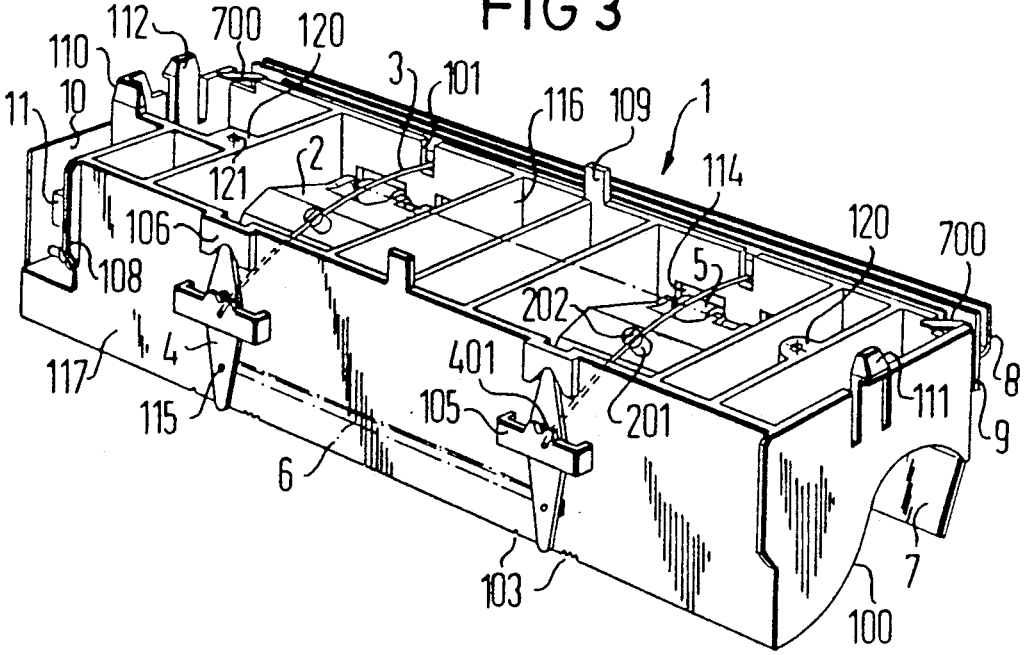

PAPER GUIDE MEANS FOR PRINTER EQUIPMENT

BACKGROUND OF THE INVENTION

The invention is directed to a paper guide means for printer equipment and, in particular to a paper guide means for conveying and positioning recording media in printer equipment, having a friction drive that conveys the recording medium and which is composed of a conveyor drum and of at least one roller carrier having appertaining paper pressing rollers and also having a trough-shaped paper guide element adapted to the conveyor drum that, together with the conveyor drum forms a guide channel for the recording media to be printed.

Apparatus of this species are notoriously known and have also been successfully employed for the greatest variety of design types of printer equipment situated in the marketplace. The most critical component parts of such paper guide means are thereby a paper carrier fashioned as a paper drum, generally a paper guide trough that is combined with paper guide rollers and is arranged under the platen such that the page to be printed that is pulled through under the platen from behind can be guided to the front into the region of the printing line.

German Utility Model No. 80 06 325 discloses a paper infeed means for printer equipment comprising a paper carrier fashioned as a paper drum and comprising a paper guide trough that has paper pressing elements and presses resiliently against the paper drum. The paper guide trough is thereby composed of a rigid roller carrier having four paper pressing rollers arranged thereon. Centrally attacking lever arrangements are attached to these paper pressing rollers. As a result of such a Cardanic suspension of the roller carriers, the paper pressing rollers press uniformly against the paper drum or, respectively, against the recording medium conducted therebetween.

DE-A No. 1-36 32 863 discloses a paper detector for a printer means having two paper guides. The paper detector comprises a reflected light sensor having a light transmission element that emits light to one of the two paper guides and having a light reception element that receives the light reflected by the paper situated in this one paper guide. Over and above this, a detector lever is provided that is moved when paper is introduced into the other paper guide. The detector lever then in turn moves a reflection plate into a position in which it covers the front side of the light sensor and the light from the light transmission element is reflected to the light reception element. The light sensor facing toward the one paper guide is in the position to identify whether paper is introduced into this paper guide or not. When the paper is introduced into the other paper guide, the reflection plate is pushed in front of the light sensor as consequence of the motion of the detector lever, so that the light coming from the light sensor is reflected by this reflection plate. In this way, a determination can be made via the reception of the light reflected in this way whether paper is present in the other paper guide or not.

U.S. Pat. No. 2,218,108 discloses a paper feed mechanism for a typewriter that has a paper guide element in the form of a metallic plate adapted to the contour of the platen. Together with the platen, the guide element limits a guide channel for the recording media and comprises clearances into which paper conveying rollers partially extend and press the recording paper against the platen.

DE-C2 32 14 549 also discloses a conveyor means for margin-perforated fanfold paper and for continuous roll paper, whereby the pressure rollers are pressed against the platen with a spring. In order to be able to set a different pressing power corresponding to the selected type of recording medium - fanfold paper or continuous roll paper -, a lever having a first and having a second lever arm is provided. This lever can be pivoted in the direction of the axis of the platen such that the lever exerts no influence on the pressing power in the one position for operation with fanfold paper and, in the other position, the second lever arm blocks the paper web of the fanfold paper and the first lever arm exerts an additional pressure onto the spring in the direction of the platen.

Given employment of such apparatus, however, the paper conveying and paper guiding parts are individually introduced, set and secured in the printer frame.

SUMMARY OF THE INVENTION

It is therefore an object of the invention to specify an apparatus for conveying and positioning recording media of the greatest variety of types that, given a manufacture that is beneficial in terms of production engineering, assures an exact positional allocation to the printing head and to the auxiliary paper mechanisms and also guarantees a positionally correct infeed of the recording media and an exact exit angle of the recording media.

In an apparatus of the species initially cited, this object is inventively achieved by the design of the paper guide element as a one-piece carrier part attachable to a printer equipment and having catch, centering and connecting element, for, on the one hand a positionally exact fastening to the carrier part of elements that serve for guidance, positioning and for conveying the recording medium, and, second, a positionally exact fixing to the printer equipment of the carrier part preassembled with the elements. The elements serving the purpose of guiding, positioning and conveying the recording medium have at least: a roller carrier seated directly at the carrier part free of moment and in pendulum fashion, this roller carrier pressing the paper pressing rollers against the conveyor drum via an adjustable spring power; a sensor means for monitoring and positioning the recording medium, the sensor means being centered with exact position and secured directly to a side wall of the carrier part; and a centerable paper pressing apron extending over the entire front wall of the carrier part and having an allocated fastening ledge that assures a defined angle of attack of the paper pressing apron relative to the conveyor drum and a defined pressing power of the paper pressing apron against the conveyor drum.

Furthermore, the roller carrier serving for the acceptance of a plurality of paper pressing rollers is guided in a recess of the carrier part transversely relative to the axis of the conveyor drum, being thusly guided with a guide trunnion that is centrally arranged at the roller carrier. Also, the pressing power for the paper pressing rollers is generated by a bending rod that attacks at the roller carrier and is adjustable in a plurality of steps.

The pressing power for the paper pressing rollers can be generated by a bending rod that attacks at the roller carrier and is adjustable in a plurality of steps. One end of the bending rod is supported at the front wall of the carrier part and the other end thereof is guided in an adjusting lever that effects the differing setting force for the roller carriers.

A plurality of roller carriers are provided at the carrier part, one bending rod and one adjusting lever being respectively allocated to each thereof and being mechanically connectable with a coupling rod such that the adjusting levers can only be pivoted in the same direction.

The paper pressing apron is realized as a metal strip and comprises at least one deflector element at its foot part, the deflector element being supported on a part of the printer chassis in the assembled condition of the paper guide means.

The paper pressing apron is fixed by centering elements and can be attached with a fastening ledge to the front wall of the carrier part. A strip composed of an absorbent material is provided between the paper pressing apron and the fastening ledge.

The sensor means comprises an optoelectronic sensor and a mechanical sensor and is secured to the carrier part via receptacle trunnions.

The carrier part, the roller carrier and the adjusting lever are composed of molded plastic parts and all clearances in the paper trough are provided with bezels and radii.

By employing a paper trough fashioned of one piece as carrier part, containing all centering noses, receptacle pegs as well as supporting, guiding, holding and fastening elements and realized as a molded plastic part a completely pre-assembleable unit is created that can be manufactured with costbeneficial technologies. In addition to exact positional allocation of the paper guide means to the printing head and to the paper auxiliaries such feeder, forms auxiliary or single sheet auxiliary, a problem-free mounting and replaceability of the entire assembly in the printer equipment also additionally derives.

When the pressing power for conveying the paper is exerted by simple, straight bending rods that act on roller carriers that are seated free of moment and in pendulum fashion and when the pressing power is set in several steps via pivotable adjusting levers, then a positionally exact infeed of the recording media by the roller wedge and a slip-free conveying of the recording media is guaranteed. Further, a processing of a variety of printing media such as foil, single sheet and endless form having various dimensions is guaranteed dependent on the plurality of roller systems. Given utilization of a plurality of such roller carriers, it is especially advantageous to mechanically connect the adjusting levers with a coupling rod, so that the adjusting levers can only be pivoted in the same direction, as a consequence whereof differing pressing power against the individual systems of paper pressing rollers is avoided.

As improvements of the invention show, the selected setting force for the paper pressing rollers can be indicated by the position of projections at adjusting levers at corresponding notches of the paper trough.

It is also advantageous that the metallic paper pressing apron that is arranged at the front wall of the paper trough and pressing and smooths the recording medium before the printing location of the printer head is fashioned as a closed surface, this preventing a contamination of the paper pressing roller with drops of ink and limiting the ink head being covered with dust due to abraded paper to a minimum. An exact paper exit angle is achieved by a defined seating and flexural length of the paper pressing apron on the basis of a fastening ledge.

A further advantage is that a connection to ground is produced by applied spring tongues at the foot part of the paper pressing apron, these being supported on a part of the printer chassis when the paper guide means of the printer equipment is integrated and thus preventing a static charging of the recording media.

According to developments of the invention, a strip of absorbent material that absorbs lost drops of ink and can be easily replaced as needed as a wear part is provided between the paper pressing apron and the fastening ledge.

In that a monitoring means composed of an optoelectronic and of a mechanical sensor is exactly centered via acceptance trunnions and is screwed on, i.e. is rigidly allocated to the paper guide means, a separate and adjustment of these sensors is superfluous.

So that the passage of the recording media in the paper trough is not impeded, all clearances in the paper trough are provided with bezels or, respectively radii and, in order to avoid a buckling of the recording media particularly given employment of fanfold papers and in order to thus avoid a line spacing error connected therewith, the shape of the paper trough has its front region adapted to the paper pressing apron.

BRIEF DESCRIPTION OF THE DRAWINGS

Further details and advantageous developments of the invention derive from the exemplary embodiment set forth in greater detail below and shown in the drawing. Shown are:

FIGS. 1 through 3 a paper guide means of the invention shown in various, perspective views;

FIG. 4 a detailed illustration of a critical part of the paper guide means.

DESCRIPTION OF THE PREFERRED EMBODIMENT

Figure 1:
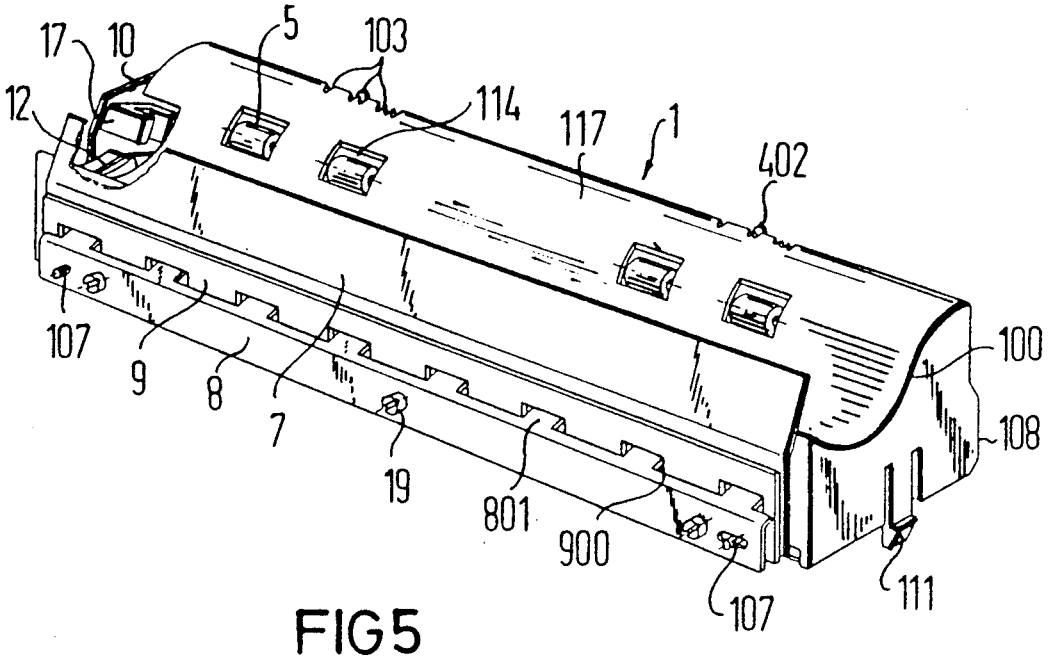
Figure 5:
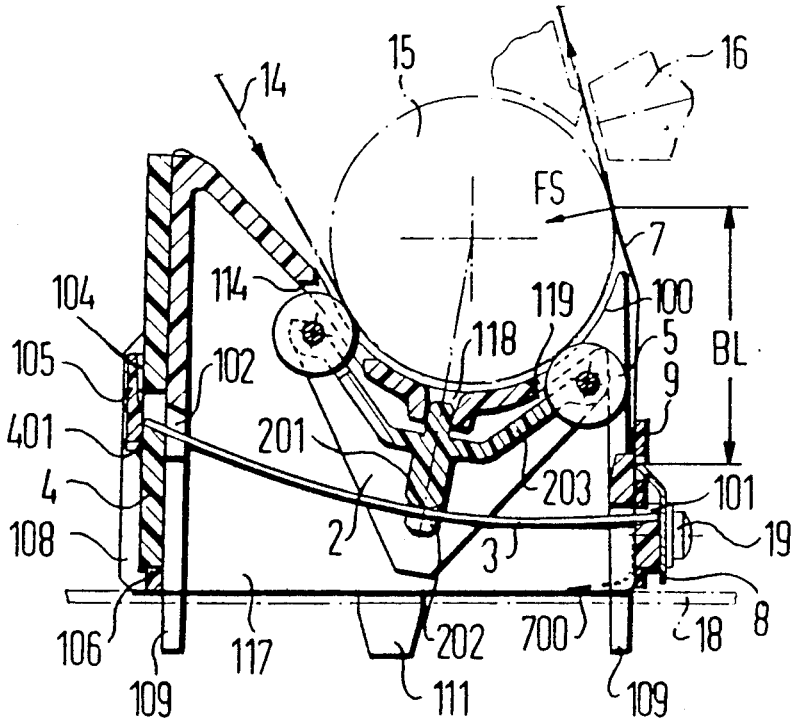
FIG. 5 a side view of the paper guide means shown in section.

A trough 117 fashioned of one piece as a carrier part and arranged over the entire width of a printer equipment (not shown here) has a wave-shaped contour 100. This contour 100 is matched to the infeed of a recording medium 14 to be printed on with the assistance of a printer head !6, to the diameter of a conveyor drum 15 and to a discharge of the recording medium 14 that is required for the printer principle that is respectively provided. For reasons of stability, the under side of the paper trough 117 is provided with a plurality of cross-webs 116 that connect the front wall and the back wall. Projections 120 into which the profiled holes 121 for fastening the paper trough 117 are applied at two cross-webs arranged in the region close to the edge. The cross-webs 116 form individual chambers that are not referenced in detail in FIGS. 1 through 3, whereby roller carriers 2 that are seated free of moment and in pendulum fashion are provided in two chambers having a certain spacing from one another. The roller carriers 2 serve for the acceptance of paper pressing rollers 5 that, together with the conveyor drum 15 serving as friction drive for the recording media 14, guarantee a slip-free paper conveying.

The roller carriers 2 contain two carrying arms 203 fashioned symmetrically relative to centrally arranged guide trunnions 201, the free ends of these carrying arms 203 being each provided with two paper pressing rollers 5 that are rotatably seated and lie next to one another at a slight spacing. Corresponding to the geometry of the paper pressing rollers 5, the surface of the paper trough 117 is interrupted at these locations with rectangular clearances 114 in the contour 100 of the paper trough 117 and rectangular recesses 119 at the edge of the paper trough 117, so that the paper pressing rollers 5 partially project from the contour 100 of the paper trough 117 and can be pressed against the conveyor drum 15. To this end, first, the guide trunnion 201 is guided in a recess 118 at the paper trough 117 at its end facing toward the conveyor drum 15 and, second, the other end of the guide trunnion 201 comprises a guide slot 202 that proceeds at a right angle relative to the direction of the printing line for the purpose of bearing a round bending rod 3 that produces the pressing power for a malfunction-free conveying of the paper onto the paper pressing rollers 5. In order to thereby prevent a lateral excursion or buckling of the bending rod 3, this is additionally supported at a cut-out portion 101 serving as seat at the front wall of the paper trough 117 and is supported against an adjusting lever 4 arranged lozenge-shaped that is arranged at the back wall of the paper trough 117. To this end, the bending rod 3 projects through a guide slot 102 at the back wall of the paper trough 117 and is seated in a sawtooth-shaped connecting member 400 in the middle of the adjusting lever 4. Since this connecting member 400 and the guide slot 102 for the bending rod 3 are covered in the mounted condition of the adjusting lever 4 in FIGS. 2 and 3, FIG. 4 shows the adjusting lever 4 in its unassembled condition. The connecting member 400 of the adjusting lever 4 thereby serves the purpose of adjusting the pressing power of the paper pressing rollers 5. Dependent on the position of the bending rod 3 in the connecting member 400, it is tensed to a greater or lesser degree and, thus, its spring lift is changed, as a consequence whereof the roller carrier 2 having the paper pressing rollers 5 seated thereon is pressed against the conveyor drum 15 with a defined force corresponding to the adjustment that is respectively selected. For fastening and bearing the adjusting lever 4, a knife-edge bearing 106 and a retaining and guide clip 105 that surrounds the adjusting lever 4 U-shaped in the region of its connecting member 400 are provided at the back side of the paper trough 117. The length of the adjusting lever 4 is dimensioned such that, when the one end of the adjusting lever 4 is seated in the knife-edge bearing 106, the other end projects somewhat beyond the upper edge of the back wall. In accord with the possible latched positions of the bending rod 3 in the sawtooth-shaped connecting member 400 of the adjusting lever 4, a plurality of groups of notches 103 that lie side-by-side are provided at the upper edge of the back wall of the paper trough 117 for identifying the latched positions. By pivoting the adjusting lever 4 with its projection 402 from a middle position referred to as standard position into one of the neighboring positions, the bending rod 3 slides in the sawtooth-shaped connecting member 400 into a neighboring latched position of the connecting member 400, as a result whereof the pressing power for the paper conveying is changed and, at the same time, the adjustment is indicated by the seat of the projection 102 at the corresponding notches 103 of the trough 117.

In its middle part, the retaining and guide clip 105 comprises an upwardly open, funnel-shaped channel 104 into which the adjustment lever 4 can be unproblematically brought in a mounting position, being prevented from falling out by a knob 401 arranged under the connecting member 400 until the bending rod 3 is mounted, the latter defining the latched position and pressing the adjusting lever 4 into the knife-edge bearing 106. In addition, bores 115 to which a coupling rod 6 that is shown with a broken line in FIG. 3 and that connects the two adjusting levers 4 can be linked as needed are provided at the adjusting levers 4 at the halves facing toward the notches 103. It is assured in this embodiment that the two adjusting levers 4 can only be pivoted in the same direction, a differing adjustment of force being thereby avoided.

A resilient paper pressing apron 7 manufactured of a metallic material that extends over the entire width of the platen 15 is provided at the front wall of the paper trough 117. The contour 100 of the paper trough 117 is adapted such to the paper pressing apron 7 on the basis of an acutely tapering edge in its front region that a buckling of the recording media 14 and a line spacing error connected therewith is avoided, particularly given employment of fanfold papers. The paper pressing apron 7 lies tangentially against the platen 15 in the region preceding the printing location of the printer head 16, as a result whereof the recording medium 14 is pressed and thereby smoothed. The pressing apron 7 is thereby fashioned as a closed surface in order to prevent the paper pressing rollers 5 from being contaminated by drops of ink given employment of an ink printer head as printing head 16 and in order to keep the dust on the ink printing head due to abraded paper material to a minimum.

Two spring tongues 700 are applied to the foot part of the paper pressing apron 7 at its regions close to the edge, these spring tongues 700 being supported on a part of the printer chassis 18 when the paper guide means 1 is mounted in the printer equipment and thereby producing a connection to ground between the paper pressing apron 7 and the printer chassis 18.

A strip 9 of expanded cellular material that absorbs the drops of ink of an ink printing head that may be potentially lost is placed against the paper pressing apron 7 over the entire width thereof. The paper pressing apron 7 and the strip 9 of expanded cellular material are pressed against the front wall of the paper trough 117 and locked with the assistance of a fastening ledge 8. Centering pins 107 integrally applied to the paper trough 117 are provided for this purpose, these centering pins 107 fixing both the paper pressing apron 7 and the strip 9 of expanded cellular material as well as the fastening ledge 8. The fastening ledge 8 is secured to the paper trough 117 with screws 19 with the assistance of three screw points symmetrically distributed over the width of the fastening ledge 8. In order to guarantee an unambiguous seating of the fastening ledge 8 and of the paper pressing apron 7, the fastening ledge 8 is interrupted in comb-like fashion. The tines 801 that thereby derive and that engage through recesses 900 of the strip 9 of expanded cellular material create a plurality of seating points, a defined seating and an exact pressing power FS of the apron thereby deriving due to a defined and constant flexural length BL of the paper pressing apron 7. An exact exit angle of the recording media 14 that is necessary given ink printing is also thereby assured. At the same time, the screwed-on fastening ledge 8 prevents the bending rod 3 from sliding out of the cut-out portion 101 at the front wall of the paper trough 117 that serves as seat.

An optoelectronic sensor in the form of a light barrier 17 arranged at the left-hand housing wall of the paper trough 117 and a mechanical sensor composed of a microswitch 11 and of a switch wire 12 allocated to this microswitch 11 serve the purpose of monitoring and positioning the recording medium 14. The light barrier 17 that, for example, can be realized has a fork light barrier having a light-emitting diode as transmitter and a photo transistor as receiver is constructed on a assembly 10 and, just like the microswitch 11, is detachably secured to the housing wall in common with a screw 13, being secured thereto with exact positional centering via acceptance trunnions 113 at the paper trough 117. The detailed structure and the functioning of such a paper monitoring means can be derived from German Patent Application P 37 31 538.2 (hereby incorporated by reference).

Seating ribs 108 that project rearward are applied at the two side walls of the paper trough 117, these seating ribs 108 serving as seating points for the paper trough 117 during pre-assembly of the paper guide means 1, for example while the fastening ledge 8 is being screwed on. Further, a plurality of downwardly projecting latch and centering elements are provided at the under side of the paper trough 117. In detail, these are a respective, cuboid-shaped seating trunnion 109 arranged at approximately half the width of the paper trough 117 at the front wall and back wall thereof and a respective snap-in nose 111 and 112 integrally applied to the side parts of the paper trough 1. In addition, a centering nose 110 that tapers wedge-shaped is provided at one of the two sides of the paper trough 117—at that side in the exemplary embodiment to which the assembly 10 is screwed. The lengths of the freely projecting ends of these catch and centering elements 109, 110, 111, 112 are matched such to one another that a mounting plane is thereby formed and the paper guide means can be flatly set, pre-assembled and seated on a support.

The completely pre-assembleable paper guide means 1 is plugged onto the printer chassis 18 in an exact position with the centering nose 110 and the snap-in noses 111 and 112 and is thereby exactly allocated to the printer equipment as well as to existing paper auxiliaries such as, for example, forms auxiliary, single sheet auxiliary or feeder and is thereby latched as mounting aid. Subsequently, it is screwed to the printer frame for securing the dimensional stability.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

We claim:

1. Paper guide means for conveying and positioning recording media (14) in printer equipment, having a friction drive that conveys the recording medium (14) and is composed of a conveyor drum (15) and of at least one roller carrier (2) having appertaining paper pressing rollers (5), and having a trough-shaped paper guide element (117) adapted to the conveyor drum (15) that, together with the conveyor drum (15) forms a guide channel for the recording media (14) to be printed, comprising:

the design of the paper guide element as a one-piece carrier part (117) attachable to a printer equipment and having catch, centering and connecting element (107, 110, 111, 112, 113, 201, 202) for, on the one hand a positionally exact fastening to the carrier part (117) of elements that serve for guidance, positioning and for conveying the recording medium (14), and, second, a positionally exact fixing to the printer equipment of the carrier part (117) preassembled with the elements, whereby the elements serving the purpose of guiding, positioning and conveying the recording medium (14) having at least a roller carrier (2) seated directly at the carrier part (117) free of moment and in pendulum fashion, this roller carrier pressing the paper pressing rollers (5) against the conveyor drum via an adjustable spring power, a sensor means (11, 12, 17) for monitoring and positioning the recording medium (14), said sensor means being centered with exact position and secured directly to a side wall of the carrier part (117), a centerable paper pressing apron (7) extending over an entire front wall of the carrier part (117) and having an allocated fastening ledge (8) that assures a defined angle of attack of the paper pressing apron (7) relative to the conveyor drum (15) and a defined pressing power (FS) of the paper pressing apron (7) against the conveyor drum (15).

2. Paper guide means according to claim 1, wherein the roller carrier (2) serving for the acceptance of a plurality of paper pressing rollers (5) is guided in a recess (118) of the carrier part (117) transversely relative to the axis of the conveyor drum (15), being thusly guided with a guide trunnion (201) that is centrally arranged at the roller carrier (2); and wherein the pressing power for the paper pressing rollers (5) is generated by a bending rod (3) that attacks at the roller carrier (2) and is adjustable in a plurality of steps.

3. Paper guide means according to claim 1, wherein the pressing power for the paper pressing rollers (5) can be generated by a bending rod (3) that attacks at the roller carrier (2) and is adjustable in a plurality of steps.

4. Paper guide means according to claim 1, wherein one end of a bending rod (3) is supported at the front wall of the carrier part (117) and the other end thereof is guided in an adjusting lever (4) that effects the differing setting force for the roller carriers.

5. Paper guide means according to claim 1, wherein a plurality of roller carriers (2) are provided at the carrier part (117), one bending rod (3) and one adjusting lever (4) being respectively allocated to each thereof and being mechanically connectable with a coupling rod (6) such that the adjusting levers (4) can only be pivoted in the same direction.

6. Paper guide means according to claim I, wherein the paper pressing apron (7) is realized as a metal strip and has at least one deflector element (700) at its foot part, said deflector element being supported on a part of the printer chassis (8) in the assembled condition of the paper guide means (1).

7. Paper guide means according to claim 1, wherein the paper pressing apron (7) is fixed by centering elements (107) and can be attached with a fastening ledge (8) to the front wall of the carrier part (117); and wherein a strip (9) composed of an absorbent material is provided between the paper pressing apron (7) and the fastening ledge (8).

8. Paper guide means according to claim 1, wherein the sensor means has an optoelectronic sensor (17) and a mechanical sensor (11, 12) and is secured to the carrier part (117) via receptacle trunnions (113).

9. Paper guide means according to claim 1, wherein the carrier part (117), the roller carrier (2) and the adjusting lever (4) are composed of molded plastic parts; and wherein all clearances in the paper trough (117) are provided with bezels and radii.

* * * * *